United States Patent [19]

Oliver et al.

[11] Patent Number: 5,056,610

[45] Date of Patent: Oct. 15, 1991

[54] SHALE DIVERTING MEANS FOR A SEALED BEARING DRILL BIT

[75] Inventors: Michael S. Oliver, Lafayette, La.; Chris E. Cawthorne, The Woodlands, Tex.; Gary Erpenbeck, Costa Mesa, Calif.

[73] Assignee: Smith International, Inc., Houston, Tex.

[21] Appl. No.: 583,902

[22] Filed: Sep. 17, 1990

[51] Int. Cl.[5] ..... E21B 10/22

[52] U.S. Cl. ..... 175/371; 384/94

[58] Field of Search ..... 175/371, 372, 337; 384/94

[56] References Cited

U.S. PATENT DOCUMENTS

| | | | |
|---|---|---|---|
| 1,641,261 | 9/1927 | Fletcher | 175/371 |
| 2,260,487 | 10/1941 | Scott | 175/371 X |
| 2,960,313 | 11/1960 | Goodwin . | |
| 3,013,621 | 12/1961 | Kinnear . | |
| 3,921,735 | 11/1975 | Dysart | 175/337 |
| 4,688,651 | 8/1987 | Dysart | 175/371 |

*Primary Examiner*—William P. Neuder

*Attorney, Agent, or Firm*—Robert G. Upton

[57] ABSTRACT

Sealed bearing rotary cone drill bits are subject to seal wear from detritus or debris generated during operation of the drill bit in a borehole. The debris invades the seal gland area resulting in premature cone bearing failure. A shale burn plug secured in the leg back face and positioned between the base of the rotary cone and the leg back face has a shale or detritus diverting ridge formed in the face of the plug. Additionally, the burn plug is energized to urge the ridged face of the burn plug against the base of the rotary cone; the ridge being radially oriented to divert debris away from the seal gland.

9 Claims, 2 Drawing Sheets

SHALE DIVERTING MEANS FOR A SEALED BEARING DRILL BIT

BACKGROUND OF THE INVENTION

I. Field of the Invention

This invention relates to sealed bearing rotary cone drill bits and a means to prevent debris from entering the bearings.

More particularly, this invention provides a spring loaded shale burn plug between a leg back face and a rotary cone to divert debris away from the seal, seal cavity and bearings.

II. Description of the Prior Art

It has long been recognized in the drill bit industry that the longevity of sealed bearing rotary cone drill bits is greatly increased if debris is prevented from entering the bearings associated with each of the rotary cones rotatively retained on legs of a drill bit. Drill bits used in carrying out rotary drilling have been subject to destruction by erosion caused by the abrasive effect of the materials present in the drilling method. Fluid circulation is employed primarily to circulate or flush the debris or cuttings from the well bore. In actual practice, mud and solids from the circulating fluid and from the earthen formation pack onto certain portions of the bit structure and this pack material flows or extrudes and moves relative to certain portions of the bit. Since great pressures are utilized in the drilling operations, the movement or flow of this pack material has adverse effects on the bit structure and, in particular, the seal cavity, seal and bearings associated with each rotary cone of the bit.

U.S. Pat. No. 2,960,313 addresses the foregoing problem. A means is provided to mechanically deflect mud and fluid material from a path that normally results in wear and destruction of a roller bit. A deflecting post or pin is provided in a leg back face. The end of the pin is adjacent a cone back face; the pin serving to deflect detritus or debris as it invades the space between the cone back face and the leg back face. The pin is fixed in the leg back face and has an exposed cylindrical end that terminates in a flat surface, the flat surface paralleling the rotary cone back face.

The deflecting post, while it is somewhat effective in intercepting the flow of debris, its circular shape can divert debris and fluid towards a seal cavity thus allowing some debris to enter this cavity.

U.S. Pat. No. 3,013,621 describes a means to deflect abrasive particles or cuttings from the space formed between a leg back face and a conical cutter. An overlay of hardened materials is welded to the leg back face at an angle to a radial plane extending from a journal center line. The abrasive material metallurgically attached to the leg back face serves to scrape or divert debris away from rotary cone bearings to prevent the debris from destroying the bearing during operation of the bit in a borehole.

The raised hardened material applied to the leg back face is less effective when the cone axially oscillates (on its journal) away from the leg back face during operation of the bit in a borehole.

The present invention has an advantage over both of these prior art mechanisms int hat the debris deflecting device is spring loaded so that the shale burn plug face remains in constant contact with the cone back face thereby providing a more reliable and effective means to deflect the debris away from the seal cavities during operation of the drill bit in a borehole.

Moreover, the shale burn plug is provided with a raised ridge in the face of the energized shale burn plug to more effectively divert debris from the seal cavity associated with each of the rotary cones.

SUMMARY OF THE INVENTION

It is an object of the present invention to provide a means to prevent debris from entering and destroying the bearings formed by the rotary cone and its journal.

It is another object of the present invention to provide a means to energize a shale burn plug to assure contact of the shale burn plug with the back face of a rotary cone, thereby maximizing protection of the seal and seal gland adjacent the bearings.

It is still another object of the present invention to provide a ridge on the exposed end of the shale burn plug to deflect debris radially away from the space formed between a leg back face and the back surface of a rotary cone.

The foregoing objects are achieved by providing a sealed bearing rotary cone drill bit having a body that forms a first pin end and a second cutting end. A downward extending leg forms an outer surface and a journal bearing integrally formed with the leg and projecting inwardly therefrom. An annular shoulder is formed at the juncture of the journal bearing and the leg. A cutter cone is rotatively mounted on the journal bearing. The cone forms an annular end face that is adjacent to the shoulder formed on the leg. The shoulder and the end face of the cone is normal to a rotary axis of the cone and has clearance therebetween. The leg further forms at least one aperture that is laterally spaced from the leg outer surface. The aperture is normal to and intersects the shoulder. At least one debris deflecting apparatus is adapted to be retained within the aperture. A deflecting face of the apparatus is adjacent the annular face of the cone and forms a debris deflecting ridge thereby. The debris deflecting apparatus is positioned in the aperture to orient the debris deflecting ridge on the face of the apparatus such that debris is deflected away from the clearance space formed between the leg and the cone.

A means is additionally provided to energize the debris deflecting apparatus to urge the ridge face of the apparatus against the annular face formed by the cone.

An advantage then of the present invention over the prior art is the debris deflecting apparatus or shale burn plug having a ridge that may be oriented to deflect debris away from the space formed between the leg back face and the rear surface of the rotary cone.

Yet another advantage to the present invention over the prior art is the means whereby the shale burn plug is energized to assure contact of the plug against the back face of the rotary cone.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
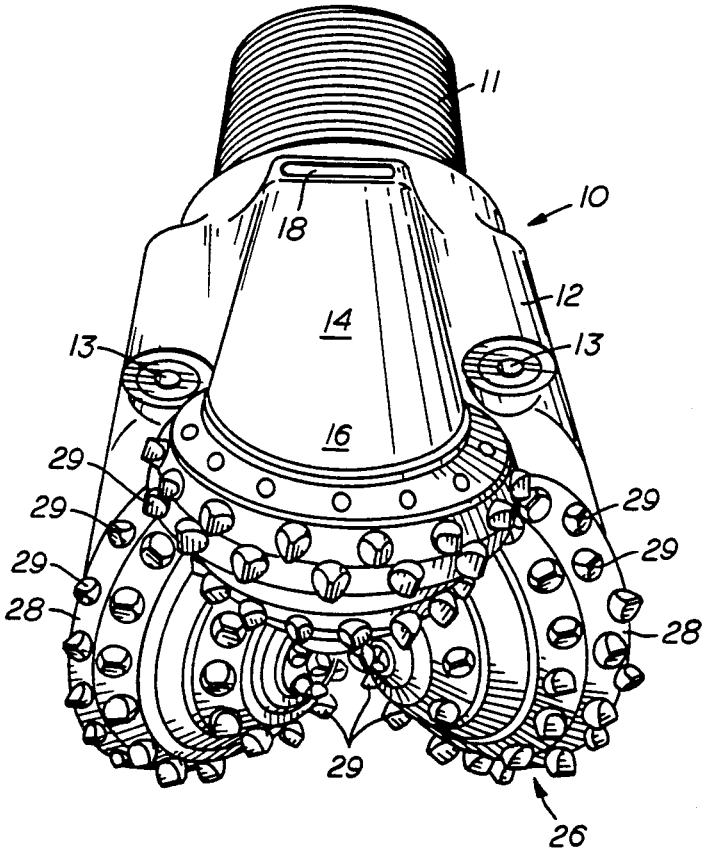
FIG. 1 is a perspective view of a sealed bearing rotary cone rock bit.

With reference now to FIG. 1, the sealed bearing rotary cone rock bit generally designated as 10 consists of rock bit body 12, pin end 11 and cuttinq end generally designated as 26. Each cone 28 making up cutting end 26 is attached to a leg 14 that terminates in a shirttail portion 16. Each of the cones 28 has for example a multiplicity of equally spaced tungsten carbide cutter inserts 29 interference fitted within insert holes formed in the cone bodies 28. A lubricant reservoir generally designated as 18 is provided in each of the legs 14 to supply lubricant to bearing surfaces formed between the rotary cones and their respective journals. Three or more nozzles 13 communicate with a chamber formed inside the bit body 12 (not shown). The chamber receives drilling fluid or "mud" through pin end 11. The fluid then is directed out through the nozzles 13 during bit operation.

Figure 2:
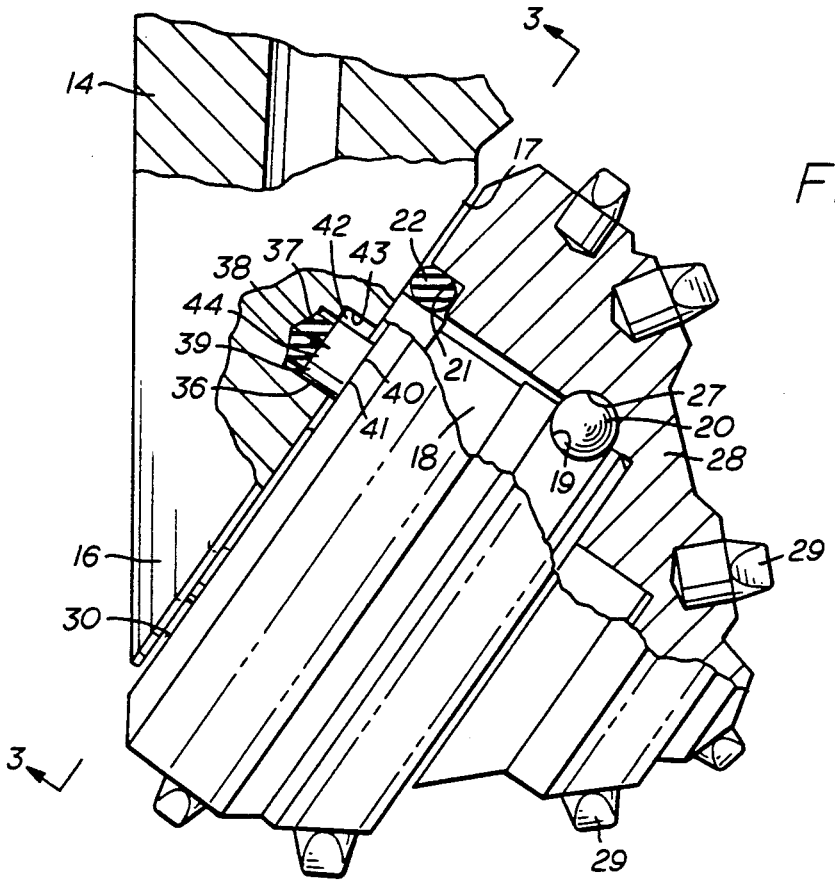
FIG. 2 is a partially broken away and sectioned view of the lower end of a leg of a rock bit illustrating a rotary cone mounted to a journal extending from the leg.

FIG. 2 illustrates a leg 14 of rock bit 10 with a cone 28 mounted on a journal bearing 18. A plurality of cone retention balls 20 are confined within a bearing race 19 formed in journal 18 and a race 27 formed in cone 28. An O-ring 22 is retained within a seal gland 21 formed in the mouth of the cone 28. The seal 22 serves to retain grease within the bearings formed between the cone 28 and the journal 18 and also serves to prevent detritus from entering past the seal gland 21 into the bearing cavities between the cone and the journal.

Leg 14 forms, at the cutting end 26 of the rock bit 10, a shirttail 16 and a leg back face 17. The leg back face 17 forms an annular shoulder at the juncture of the journal bearing 18 and the leg 14. The cone 28 forms an annular end face 30 that is spaced from and adjacent to annular shoulder 17 of leg 14. As heretofore mentioned debris tends to pack into the annular space formed between the cone back face 30 and the leg back face 17. The debris eventually packs in and works its way into the seal bearings while the bit operates in a borehole (not shown).

A debris deflecting plug or shale burn plug generally designated as 38 is slideably retained within a burn plug retention aperture 36 formed in the leg shoulder or back face 17. The shale burn plug 38 is preferably fabricated from tungsten carbide (WC). The aperture 36 is sufficiently deep to retain, for example, an elastomeric material or a leaf or coil spring 44. The preferred elastomeric material (a highly saturated nitrile compound or rubber) bottoms out in the aperture 36 and is pressed against base 37 of the plug body 39. Plug face 40 has, for example, a ridge 41 formed by the shale burn plug body 39. A detent pin 42 is an integral part, for example, of the plug body 39 and is aligned with a detent recess 43 formed in the leg back face 17. (See FIGS. 3 and 4). The top of the shale burn plug (side contacting cones) surface 40 may be coated with a harder more abrasive resistant material such as diamond to prevent surface wear.

Figure 3:
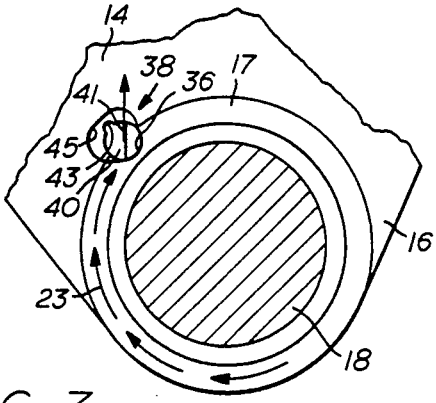
FIG. 3 is a fragmented view taken through 3—3 of FIG. 2 illustrating the leg back face and cone with a debris deflecting shale burn plug mounted within the leg back face.
Figure 4:
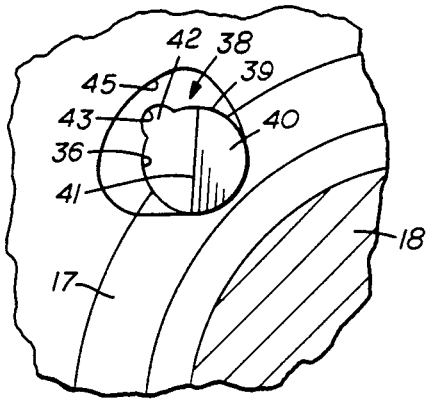
FIG. 4 is an enlargement of a segment of FIG. 3 emphasizing the protruding detent that is aligned with a slot formed in the leg back face to prevent rotation of the shale burn plug.

Referring now to FIGS. 3 and 4, the plug body 39 is slideably engaged with aperture 36 formed in leg back face 17. The alignment pin or detent 42 is engaged with detent recess 43 in such a manner as to align ridge 41 to most advantageously deflect detritus 23 as it enters the space formed between the cone and the leg back face.

A recess 45 is also formed in the leg recess 17 to provide a depression surrounding the burn plug 38 to accumulate and direct debris toward impact with deflecting ridge 41 formed in face 40 of the plug body 39.

Figure 5:
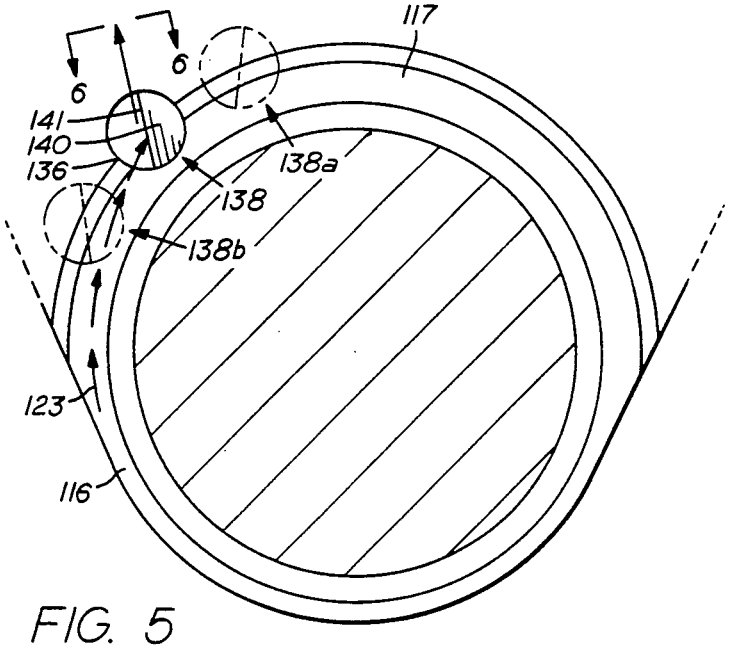
FIG. 5 is a sectional view illustrating the shale burn plug and the ridge formed in the face of the plug, the ridge being oriented to direct debris away from the journal bearings.
Figure 6:
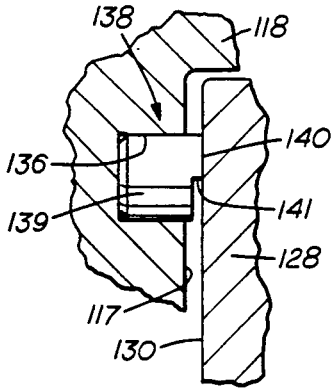
FIG. 6 is a fragmented view taken through 6—6 of FIG. 5 illustrating the burn plug adjacent the back surface of the cone.

With reference now to FIGS. 5 and 6, an alternative embodiment illustrates a shale burn plug generally designated as 138 interference fitted within a shale burn plug aperture 136 formed in leg back face 117. The shale burn plug 138 forms a plug body 139 with a base 137 and a plug face 10. A ridge 141 is formed in face 140 to deflect debris as it enters the space formed between the leg back face 117 and the cone back face 130.

With reference specifically to FIG. 5, the shale burn plug 138 is pressed into its aperture 136 in leg 14 such that the angle of the ridged face 140 deflects debris away from the seal gland and bearings formed between the journal 118 and the cone 128. As shown in FIG. 5, the location of the aperture 136 formed in the leg back face 117 may be in several different circumferential positions in the back face. Additionally there may be a pair of shale burn plugs 138 and **138*a* to provide a redundant detritus diverting means. Additionally there may be as many as three shale burn plugs 138, 138*a* and 138*b*, circumferentially aligned or not aligned as the case may be (different radial distances from the journal axis) to deflect debris as it enters the space formed between the leg back face and the cone back face 117 and 130. Debris that may be missed by shale burn plug 138 is picked up by backup shale burn plug 138*a*. The angle of the ridge 141** may, of course, be varied to best deflect debris or detritus as it enters the space between the cone and the leg.

Figure 7:
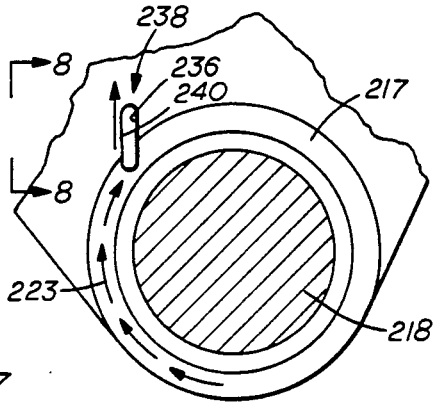
FIG. 7 is a cross section through a journal bearing illustrating an alternate shale burn plug.

A second alternative embodiment is illustrated with reference to FIGS. 7 and 8 wherein a rectangulary-shaped shale burn plug 238 is slideably retained within a complimentary rectangularly-shaped aperture 236 formed in leg back face 217. It would be obvious to utilize other shapes such as oval, elliptical, etc. without departing from the invention. The shale burn plug 238 is urged against the cone back face by, for example, a rubber spring 244 placed between the bottom of the aperture 236 and the base of the body 239 of the shale burn plug 238. The face of the rectangular burn plug 240 is urged against the cone back face 230, thus accommodating for any axial oscillations of the cone on the journal bearing 218. The rectangular slot 236 in leg back face 217 is oriented obliquely with respect to a radial line emanating from a journal axis such that it sufficiently deflects debris as it enters the space formed between the leg back face 217 and the cone back face 230. The angled orientation of the burn plug 240 may be varied to best deflect detritus from the space between leg and cone.

Figure 8:
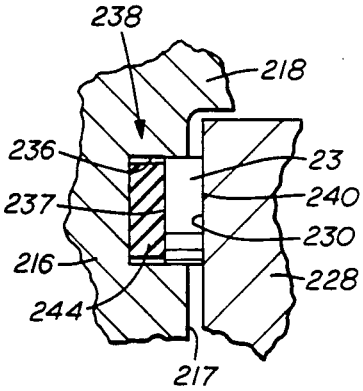
FIG. 8 is a cross sectional view taken through 8—8 of FIG. 7 illustrating the energized rectangularly shaped shale burn plug.

It is important to maintain contact of the face 240 with the cone back face 230 to most effectively prevent debris from entering the journal bearings formed between the cone 228 and the journal bearing 218, as is most clearly shown in FIG. 8.

Referring now specifically to FIGS. 2 and 8, it can be seen that cylindrical plug face 40 in FIG. 2 and the rectangular plug face 240 in FIG. 8 is in constant contact with the cone back faces 30 and 230 thus assuring there are no gaps between the burn plug faces 40 and 240 thereby substantially preventing debris from entering the bearings of the bit.

Moreover, the shale burn plugs 38 and 238 may be slideably retained within a hardfacing sleeve pressed into the leg back face apertures 36 and 236 to prevent cocking of the burn plug through wear of the plugs 38 and 238 during operation of the bits in a borehole without departing from the scope of this invention (not shown). The sleeve also serves to protect the apertures 36 and 236 from wear.

It would be obvious to provide a cylindrical shale burn plug with a flat end face that is urged in contact with an annular end face of a rotary cone by an elastomer or spring without departing from the intent of this invention (not shown).

It will of course be realized that various modifications can be made in the design and operation of the present invention without departing from the spirit thereof. Thus while the principal preferred construction and mode of operation of the invention have been explained in what is now considered to represent its best embodiments which have been illustrated and described. It should be understood that within the scope of the appended claims the invention may be practiced otherwise than as specifically illustrated and described.

What is claimed is:

1. A sealed bearing rotary cone drill bit comprising:

a body forming a first pin end and a second cutting end, a downward extending leg, said leg having an outer surface, a journal bearing formed integrally with the leg and projecting inward therefrom, an annular shoulder formed at the juncture of the journal bearing and the leg;

a cutting cone rotatively mounted on the journal bearing, the cone forming an annular end face adjacent said shoulder, the shoulder and the end face being normal to a rotary axis of the cones and having clearance space therebetween, the leg further forming at least one aperture laterally spaced from the leg outer surface, the aperture being normal to and intersecting the shoulder; and a debris deflecting apparatus adapted to be retained within said at least one aperture, a face of said apparatus adjacent said annular face of said cone and forming a debris deflecting ridge thereby, elastomeric means to energize said debris deflecting apparatus to urge said ridged face of said apparatus against said annular face of said cone, said debris defelecting apparatus being so positioned in said aperture to orient said debris deflecting ridge such that debris is directed away from said clearance space between said leg and said cone.

2. The invention as set forth in claim 1 wherein said aperture formed in said leg is a cylindrical bore, said cylindrical bore being normal to and intersecting said shoulder, said debris deflecting apparatus being a cylindrically shaped pin adapted to be inserted within said cylindrical bore in said leg.

3. The invention as set forth in claim 2 wherein said cylindrical debris deflecting apparatus is comprised of a tungsten carbide material.

4. The invention as set forth in claim 3 wherein means are provided to prevent said cylindrical debris deflecting apparatus from rotating within said bore formed in said leg.

5. The invention as set forth in claim 4 wherein said means to prevent rotation of said cylindrical debris deflecting apparatus is a detent extending from said debris deflecting apparatus, said detent is adapted to be retained within a complementary groove formed in said annular shoulder adjacent a wall of said aperture, said detent prevents said debris deflecting apparatus from rotating as it engages said face surface of said cone.

6. The invention as set forth in claim 1 wherein said aperture is rectangular in shape, said aperture being oriented at an oblique angle with respect to a radius from an axis of said journal bearing, said debris deflecting apparatus being rectangularly shaped and retained by said rectangularly shaped aperture, said debris deflecting apparatus being angled by said aperture such that debris is directed away from said clearance space between said leg and said cone.

7. The invention as set forth in claim 6 further comprising an elastomeric means contained within said aperture between a bottom of said aperture formed by said leg and a base formed by said rectangularly shaped debris deflecting apparatus, said elastomeric means serves to urge said debris deflecting apparatus against said annular face of said cone.

8. A sealed bearing rotary cone drill bit comprising:

a body forming a first pin end and a second cutting end, a downward extending leg, said leg having an outer surface, a journal bearing formed integrally with the leg and projecting inward therefrom, an annular shoulder formed at the juncture of the journal bearing and the leg;

a cutter cone rotatively mounted on the journal bearing, the cone forming an annular end face adjacent said shoulder, the shoulder and the end face being normal to a rotary axis of the cone and having clearance space therebetween, the leg further forming a cylindrically shaped aperture laterally spaced from the leg outer surface, the aperture being normal to and intersecting the shoulder;

a cylindrically shaped debris deflecting apparatus adapted to be slideably retained within said aperture, a face of said apparatus adjacent said annular face of said cone forms a debris deflecting ridge thereby, an elastomeric means to energize said debris deflecting apparatus to urge said ridged face of said apparatus against said annular face of said cone, and a detent means formed in a sidewall of said debris deflecting apparatus said detent means being adapted to be retained within a complimentary groove formed in said annular shoulder adjacent a wall of said aperture, said detent prevents said debris deflecting apparatus from rotating as it engages said face surface of said cone, said debris deflecting apparatus being so positioned in said aperture to orient said debris deflecting ridge formed on said face of said apparatus such that debris is directed away from said clearance space between said leg and said cone.

9. The invention as set forth in claim 8, wherein said means to urge said debris deflecting apparatus against said annular face of said cone is an elastomeric material.

* * * * *